US007753318B2

(12) United States Patent
Wagner et al.

(10) Patent No.: US 7,753,318 B2
(45) Date of Patent: Jul. 13, 2010

(54) SYSTEM AND METHOD FOR TEMPORARY PROTECTION OPERATION OF A CONTROLLER BOX FOR A RAILROAD SWITCH TURNOUT

(75) Inventors: Don R. Wagner, Lee's Summit, MO (US); Harold L. Fear, Oak Grove, MO (US)

(73) Assignee: General Electric Company, Schenectady, NY (US)

( * ) Notice: Subject to any disclaimer, the term of this patent is extended or adjusted under 35 U.S.C. 154(b) by 618 days.

(21) Appl. No.: 11/669,271

(22) Filed: Jan. 31, 2007

(65) Prior Publication Data

US 2008/0179467 A1 Jul. 31, 2008

(51) Int. Cl.
*B61L 5/00* (2006.01)

(52) U.S. Cl. ..... 246/220; 246/253

(58) Field of Classification Search ..... 246/220, 246/253, 260, 448, 476, 223, 225, 219, 218, 246/401, 162; 701/19, 20
See application file for complete search history.

(56) References Cited

U.S. PATENT DOCUMENTS 2,575,994 A 11/1951 Bone et al.
5,806,809 A 9/1998 Danner
6,149,106 A 11/2000 McQuistian
6,691,958 B2 2/2004 Biagiotti
7,147,189 B2 * 12/2006 Brown et al. ..... 246/220

FOREIGN PATENT DOCUMENTS

WO WO 2006/086671 8/2006

* cited by examiner

*Primary Examiner*—Mark T Le
(74) *Attorney, Agent, or Firm*—Robert Wawrzyn, Esq.; Terry M. Sanks, Esq.; Beusse Wolter Sanks Mora & Maire, P.A.

(57) ABSTRACT

A system is provided for temporary protection operation of at least one controller box for a railroad switch turnout in a powered mode or non-power mode depending on the railroad configuration and independent of the controller box. A normal controller box is coupled to the normal switch point and includes a block slidably received within the housing based on moving the normal switch point to establish at least one pair of electrical contacts within the housing. A controller is coupled to the controller box to verify a pair of compressed contacts to determine that the normal switch point has moved to the normal position to cause the controller box to send an open signal to a pair of switch connections. The controller also verifies a pair of extended contacts to determine that the normal switch point has failed to move to the normal position to omit to cause said controller box to send an open signal to the pair of switch connections and maintain each respective switch connection to shunt the stationary stock rails.

10 Claims, 8 Drawing Sheets

SYSTEM AND METHOD FOR TEMPORARY PROTECTION OPERATION OF A CONTROLLER BOX FOR A RAILROAD SWITCH TURNOUT

FIELD OF THE INVENTION

The present invention relates to the operation of railroad signaling systems, and more particularly, to a system, method and microprocessor readable media for temporary protection operation of a controller box for a railroad switch turnout.

BACKGROUND OF THE INVENTION

In order to optionally switch a railroad train operating on a first track to a second, merging track, it is typical to provide a railroad switch with a pair of switch points which are selectively movable horizontally to deflect the train toward one or the other of the tracks. The railroad switch can encompass a pair of movable switch rail lengths which extend several feet in length with the switch points. The switch points, typically labeled as "normal" and "reverse", are selectively movable back and forth between a pair of stock rails between a normal position in which a normal stock rail is positioned against a respective movable switch rail and a reverse position in which a reverse stock rail is positioned against a respective movable switch rail.

Several railroad switches include respective switch points employing electronic proximity sensors positioned on each stock rail for producing high current upon a respective movable switch rail approaching each stock rail. However, such electronic proximity sensors are costly, unreliable and not rated in extreme environmental temperature fluctuations. Additionally, these electronic proximity sensors do not facilitate non-power applications of such railroad switches, aka the passing through of track circuit indication or the shunting of the same track circuit indication.

Current railroad switch systems typically include multiple controller boxes for operating in respective powered or non-powered modes. Accordingly, it would be advantageous, in terms of efficiency, to have a railroad switch system with one controller box for operating in both the powered and non-powered mode.

BRIEF DESCRIPTION OF THE INVENTION

In one embodiment of the present invention, a system is provided for protection in power operation of a controller box for a railroad switch turnout in a powered mode. The railroad switch turnout includes a normal and a reverse switch point positioned between respective normal and reverse stationary stock rails and a pair of movable switch rails disposed between the stationary stock rails. The normal and reverse switch points are movable between a normal position and a reverse position. The system includes a normal controller box coupled to the normal switch point to move the normal switch point between the normal position and out of the normal position. The system further includes a reverse controller box coupled to the reverse switch point for moving the reverse switch point between the reverse position and out of the reverse switch position. Each controller box includes a housing, at least one block slidably received within the housing based upon moving each respective normal and reverse switch point to establish at least one pair of electrical contacts within the housing. Each pair of electrical contacts include at least one pair of extended contacts and at least one pair of compressed contacts. More particularly, the controller box includes at least one pair of switch connections coupling each pair of compressed contacts to the respective normal and reverse stationary stock rails carrying respective rail current. Additionally, the system includes a normal controller coupled to each normal controller box to verify each pair of compressed contacts to determine that the normal switch point has moved to the normal position for causing the normal controller box to send an open signal to each pair of switch connections to open each pair of switch connections. Additionally, the normal controller is coupled to each normal controller box to verify each pair of extended contacts to determine that the normal switch point has failed to move to the normal position for omitting to cause the normal controller box to send the open signal to each pair of switch connections to maintain each respective switch connection for shunting the stationary stock rails. The system further includes a reverse controller coupled to each reverse controller box to verify each pair of compressed contacts to determine that the reverse switch point has moved to the reverse position for causing the reverse controller box to send an open signal to each pair of switch connections to open each pair of switch connections. Additionally, the reverse controller is coupled to each reverse controller box to verify each pair of extended contacts to determine that the reverse switch point has failed to move to the reverse position for omitting to cause the reverse controller box to send the open signal to each pair of switch connections to maintain each respective switch connection for shunting the stationary stock rails.

In another embodiment of the present invention, a system is provided for temporary protection operation of a controller box for a railroad switch turnout in a non-powered mode. The railroad switch turnout includes a normal and a reverse switch point positioned between respective normal and reverse stationary stock rails and a pair of movable switch rails disposed between the stationary stock rails. The normal and reverse switch points are movable between a normal position and a reverse position. The system includes a normal controller box coupled to the normal switch point to move the normal switch point between the normal position and the reverse position. Each normal controller box includes a housing, at least one block slidably received within the housing based upon moving the normal switch point to establish at least one pair of electrical contacts within the housing. Each pair of electrical contacts include at least one pair of compressed contacts indicative of moving the normal switch point into the normal position and at least one pair of extended contacts indicative of moving the normal switch point out of the normal position. The normal controller box further includes a pair of rail connections coupling each pair of electrical contacts to a respective normal and reverse stationary stock rail. Upon establishing each pair of compressed contacts, the pair of rail connections and pair of compressed contacts facilitate respective opposing current along the normal and reverse stationary stock rails indicative of a safe condition of the railroad switch turnout. Upon establishing each pair of extended contacts, the pair of rail connections and pair of extended contacts facilitate shunting of the respective normal and reverse stationary stock rails indicative of an unsafe condition of the railroad switch turnout.

In another embodiment of the present invention, a method is provided for temporary protection operation of a controller box for a railroad switch turnout in a powered mode. The railroad switch turnout includes a normal and a reverse switch point positioned between respective normal and reverse stationary stock rails and a pair of movable switch rails disposed between the stationary stock rails. The normal and reverse switch points are movable between a normal position and a reverse position. The method includes coupling at least one normal controller box to the normal switch point, and moving the normal switch point between the normal position and the reverse position including slidably receiving at least one block of each controller box within a housing of each controller block. Additionally, the method includes establishing at least one pair of electrical contacts within the housing based upon moving the normal switch point between the normal position and the reverse position. Each pair of electrical contacts includes at least one pair of extended contacts and at least one pair of compressed contacts. Additionally, the method includes coupling at least one pair of switch connections from each pair of compressed contacts to the respective normal and reverse stationary stock rails carrying respective rail current. More particularly, the method includes coupling a normal controller to the at least one normal controller box. Additionally, the method includes verifying each pair of compressed contacts to determine that the normal switch point has moved to the normal position for causing the normal controller box to send an open signal to each pair of switch connections to open each pair of switch connections. The method further includes verifying each pair of extended contacts to determine that the normal switch point has failed to move to the normal position for omitting to cause the normal controller box to send the open signal to each pair of switch connections to maintain each respective switch connection for shunting the stationary stock rails.

In another embodiment of the present invention, computer readable media containing program instructions are provided for a method for temporary protection operation of a controller box for a railroad switch turnout in a powered mode. The railroad switch turnout includes a normal and a reverse switch point positioned between respective normal and reverse stationary stock rails and a pair of movable switch rails disposed between the stationary stock rails. The normal and reverse switch points are movable between a normal position and a reverse position. The method includes coupling at least one normal controller box to the normal switch point, and moving the normal switch point between the normal position and the reverse position including slidably receiving at least one block of each controller box within a housing of the controller box. The method further includes establishing at least one pair of electrical contacts within the housing based upon the moving the normal switch point between the normal position and the reverse position. Each pair of electrical contacts includes at least one pair of extended contacts and at least one pair of compressed contacts. The method further includes coupling at least one pair of switch connections from each pair of compressed contacts to the respective normal and reverse stationary stock rails carrying respective rail current. The method further includes coupling at least one normal controller to each normal controller box. The computer readable media includes a computer program code to verify each pair of compressed contacts to determine that the normal switch point has moved to the normal position to cause the normal controller box to send an open signal to at least one pair of switch connections to open the at least one pair of switch connections. The computer readable media further includes a computer program code to verify each pair of extended contacts to determine that the normal switch point has failed to move to the normal position to omit to cause the controller box to send the open signal to each pair of switch connections to maintain each respective switch connection for shunting the stationary stock rails.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
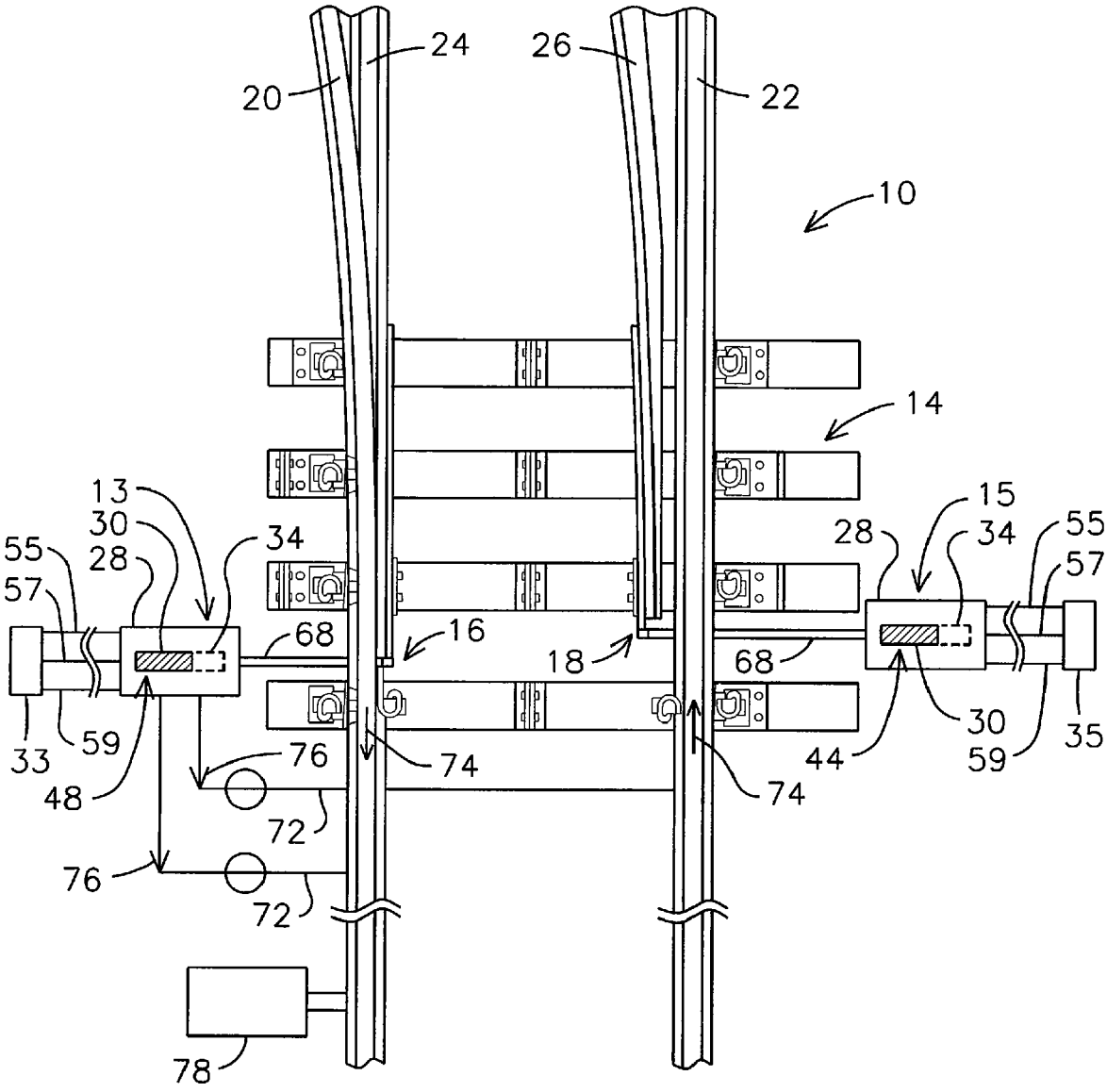
FIG. 1 is a top view of one embodiment of a system for providing temporary protection operation of a controller box for a railroad switch turnout in a normal position.

FIG. 1 illustrates an embodiment of a system 10 for providing temporary protection operation to a normal controller box 13 and reverse controller box 15 of a railroad switch turnout 14 in a powered mode. The railroad switch turnout 14 illustratively includes a normal and a reverse switch point 16,18 positioned between respective normal and reverse stationary stock rails 20,22 and a pair of movable switch rails 24,26 disposed between the stationary stock rails. The normal and reverse switch points 16,18 are movable between a normal position (FIG. 1) and a reverse position (FIG. 2).

Figure 2:
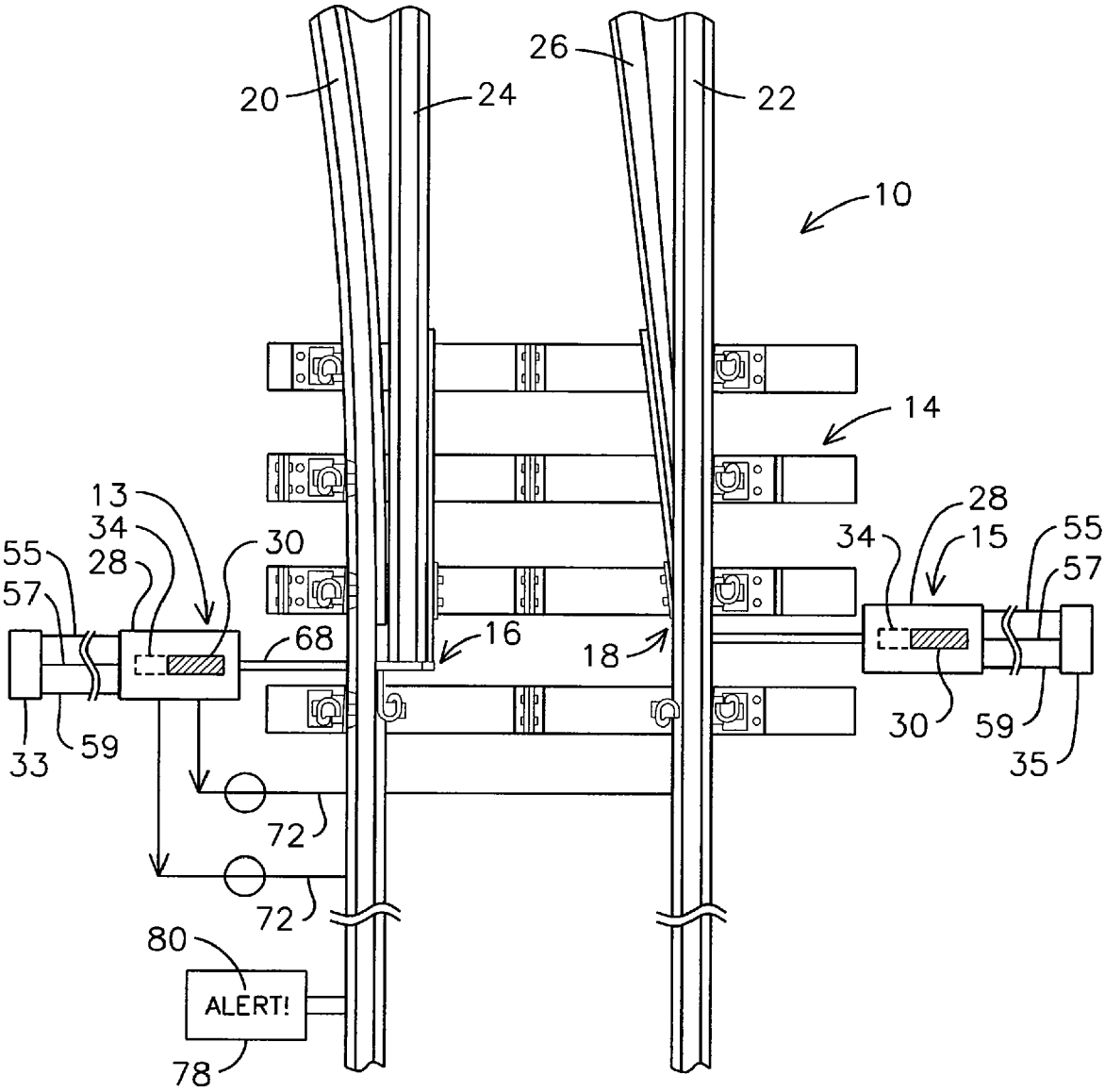
FIG. 2 is a top view of one embodiment of a system for providing temporary protection operation of a controller box for a railroad switch turnout in a reverse position.
Figure 3:
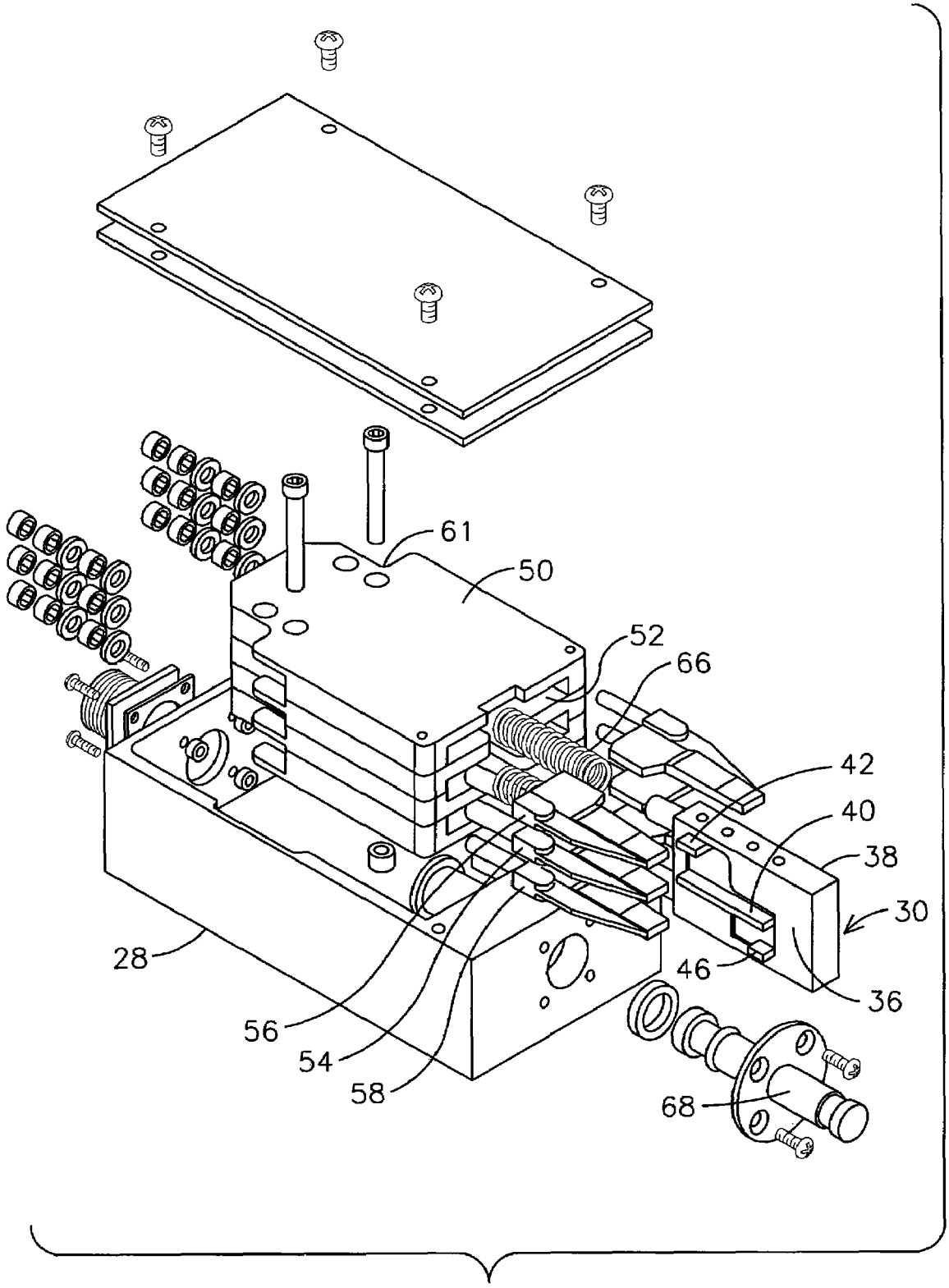
FIG. 3 is a perspective exploded view of one embodiment of a controller box in accordance with the present invention.

As illustrated in FIGS. 1 and 2, the system 10 includes a normal controller box 13 coupled to the normal switch point 16 to move the normal switch point between the normal position (FIG. 1) and out of the normal position, such as into the reverse position, for example (FIG. 2). The system 10 further includes a_reverse controller box 15 coupled to the reverse switch point 18 to move the reverse switch point between the reverse position (FIG. 2) and out of the reverse position, such as into the normal position, for example (FIG. 1). As illustrated in FIGS. 1-3, each controller box 13,15 includes a housing 28, a block 30 slidably received within the housing 28 based on moving the respective normal and reverse switch point 16,18 to establish a pair of electrical contacts 40, 42 and 40, 46 within the housing. Each pair of electrical contacts includes a pair of extended contacts 40,42 and a pair of compressed contacts 40,46. Although FIGS. 1-3 illustrate one block 30 within the housing 28, more than one block may be positioned within the housing and equipped with electrical contacts, as discussed below. Additionally, although each side 36,38 of the block 30 includes one pair of extended contacts (40,42) (41,43) and one pair of compressed contacts (40,46) (41,47), each side may include more than one of the extended and compressed contacts. The extended and compressed contacts on either side of the block 30 are mutually insulated from those contacts on the opposing sides, but a block having connected electrical contacts on opposing sides may be utilized.

Each controller box 13,15 further illustratively includes a pair of switch connections 72 coupling each pair of compressed contacts 40,46 to the respective normal and reverse stationary stock rails 20,22 carrying respective rail current 74. Although FIGS. 1-2 illustrate the normal controller box 13 coupling its compressed contacts 40,46 to the pair of switch connections 72, the reverse controller box 15 is similarly coupled to a pair of switch connections and the respective normal and reverse stationary stock rails 20,22, but not illustrated for clarity.

As further illustrated in FIG. 1, the system 10 further includes a normal controller 33 coupled to the normal controller box 13 to verify the pair of compressed contacts 40,46 for determining that the normal switch point 16 has moved to the normal position (FIG. 1). The normal controller 33 is illustratively tied in parallel with each pair of extended contacts (40,42) and compressed contacts (40,46) of each normal controller box 13, through the various wire couplings running from the normal controller box to the normal controller, as discussed further below. Upon determining that the normal switch point 16 is in the normal position, the normal controller 33 causes the normal controller box 13 to send an open signal 76 to a pair of switch connections 72 to open the pair of switch connections. In addition, the normal controller 33 verifies the pair of extended contacts 40,42 to determine that the normal switch point 16 has failed to move to the normal position (FIG. 2) for omitting to cause the normal controller box 13 to send the open signal 76 to the pair of switch connections 72 to maintain each respective switch connection for shunting the stationary stock rails 20,22. The system 10 further includes a reverse controller 35 coupled to the reverse controller box 15 to verify the pair of compressed contacts 40,46 for determining that the reverse switch point 18 has moved to the reverse position (FIG. 2). Upon determining that the reverse switch point 18 is in the reverse position, the reverse controller 35 causes the reverse controller box 15 to send an open signal 76 to a pair of switch connections (not shown) to open the pair of switch connections. In addition, the reverse controller 35 verifies the pair of extended contacts 40,42 to determine that the reverse switch point 18 has failed to move to the reverse position (FIG. 1) for omitting to cause the reverse controller box 15 to send the open signal 76 to the pair of switch connections (not shown) to maintain each respective switch connection for shunting the stationary stock rails 20,22. Although FIG. 1 illustrates one pair of switch connections 72, more than one pair of switch connections may be used. In addition, although FIG. 1 illustrates one normal and reverse controller 33,35 respectively coupled to each normal and reverse controller box 13,15, more than one controller may be utilized in monitoring the electrical contacts, as discussed below.

As illustrated in FIGS. 1-2, the system 10 further includes an alert indicator 78 coupled to the normal and reverse stationary stock rails 20,22 to display an alert 80 responsive to the shunting of the stationary stock rails. Such an alert indicator 78 operates to detect the shunting according to its effect on the rail current 74 on each stationary stock rail 20,22, as appreciated by one of skill in the art.

Successive electrical contacts for each pair of electrical contacts 40,42 and 40,46 may be established based upon sliding the block 30 a first incremental distance 34 within the housing 28. The first incremental distance is adjustable and may be set according to regulations of a minimum variance distance of the normal switch point 16 outside the normal position, for example.

Figure 4:
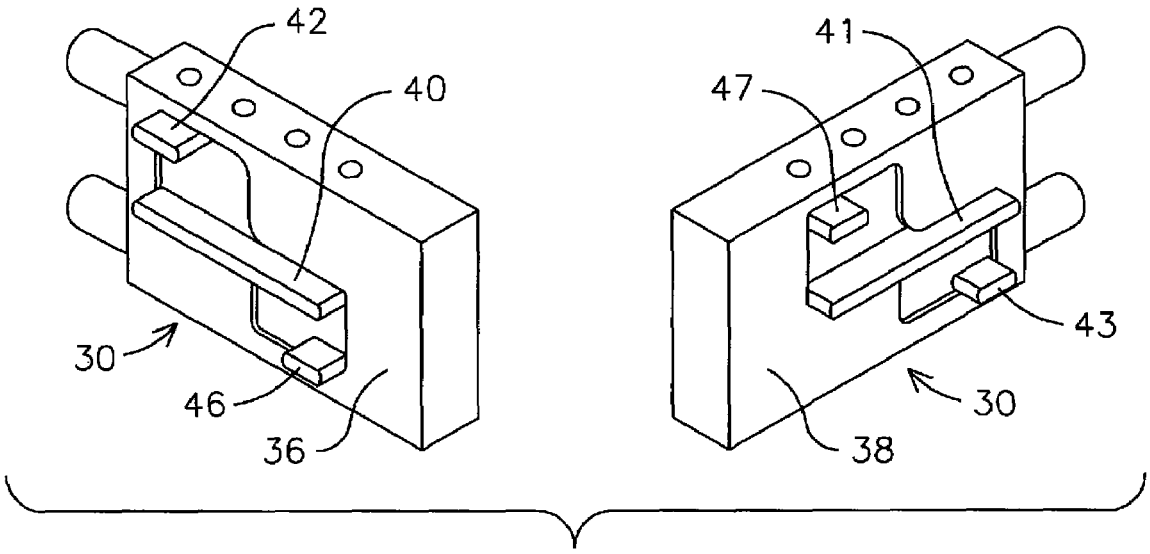
FIG. 4 is an isolated perspective exploded view of one embodiment of a block in accordance with the present invention.
Figure 6:
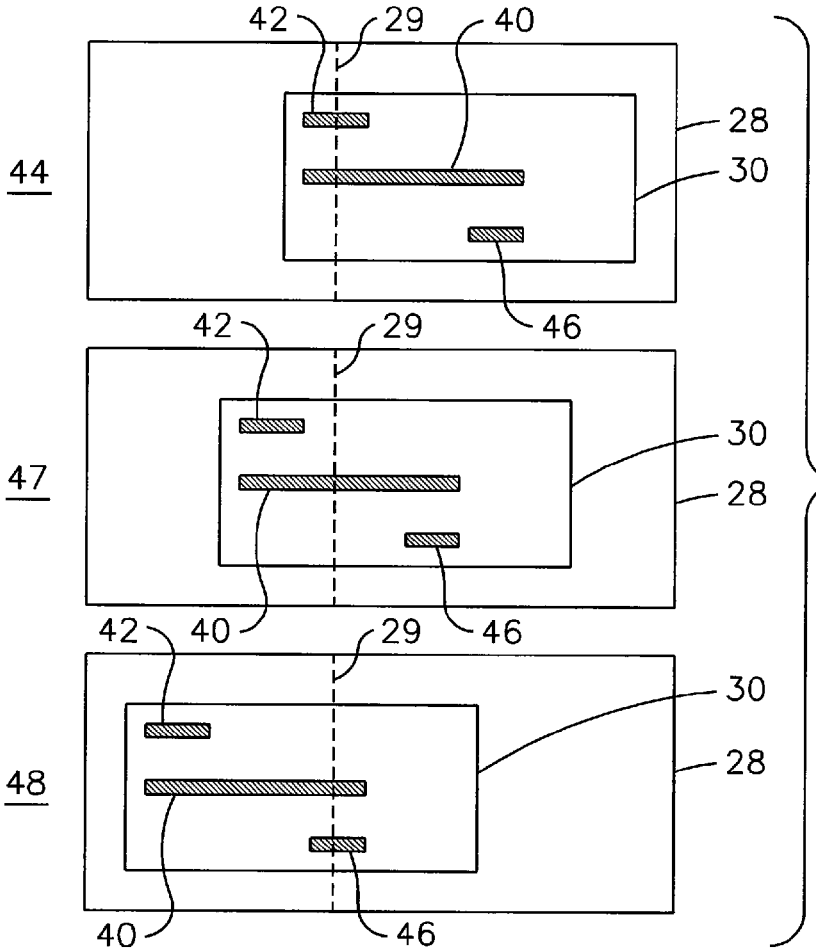
FIG. 6 is a partial sectional side view of a controller box in accordance with an embodiment of the present invention.

As illustrated in FIGS. 3, 4 and 6, the block 30 includes a plurality of male contacts 40,42,46 and 41,43,47 on each side 36,38 of the block. The plurality of male contacts illustratively include a pair of middle contacts 40,41, and a pair of extended contacts 42,43 to establish a pair of electrical contacts with a respective pair of middle contacts 40,41 on opposing sides 36,38 of each block when the block 30 is in an extended position 44 within the housing. The plurality of male contacts further includes a pair of compressed contacts 46,47 to establish a pair of electrical contacts with a respective pair of middle contacts 40,41 on opposing sides 36, 38 of each block when the block is in a compressed position 48 within the housing.

As illustrated in FIG. 3, the block 30 is slidably received within a secondary block 50 within the housing 28. The secondary block 50 includes a plurality of openings 52 for receiving a respective plurality of female contacts 54,56,58, 71, 73,75 coupled to a respective outlet 55,57,59,49,51,53, at a back end 61 of the secondary block 50. Each female contact 54,56,58,71,73,75 aligns with a respective male contact 40,42,46,41,43,47 on opposing sides 36,38 of the block 30 for mating with the respective male contact. Although FIG. 3 illustrates the male and female contacts of one side 36 of the block 30, the male and female contacts of the opposing side 38 are similar in structure.

Although FIG. 3 illustrates a plurality of female contacts received within the openings 52 and for mating with respective male contacts on opposing sides 36,38 of the block 30, the secondary block 50 may include a plurality of openings 52 for receiving a respective plurality of male contacts coupled to a respective outlet at a back end of the secondary block 50. Each male contact may align with a respective female contact on opposing sides of the block 30 for mating with the respective female contact.

Figure 5:
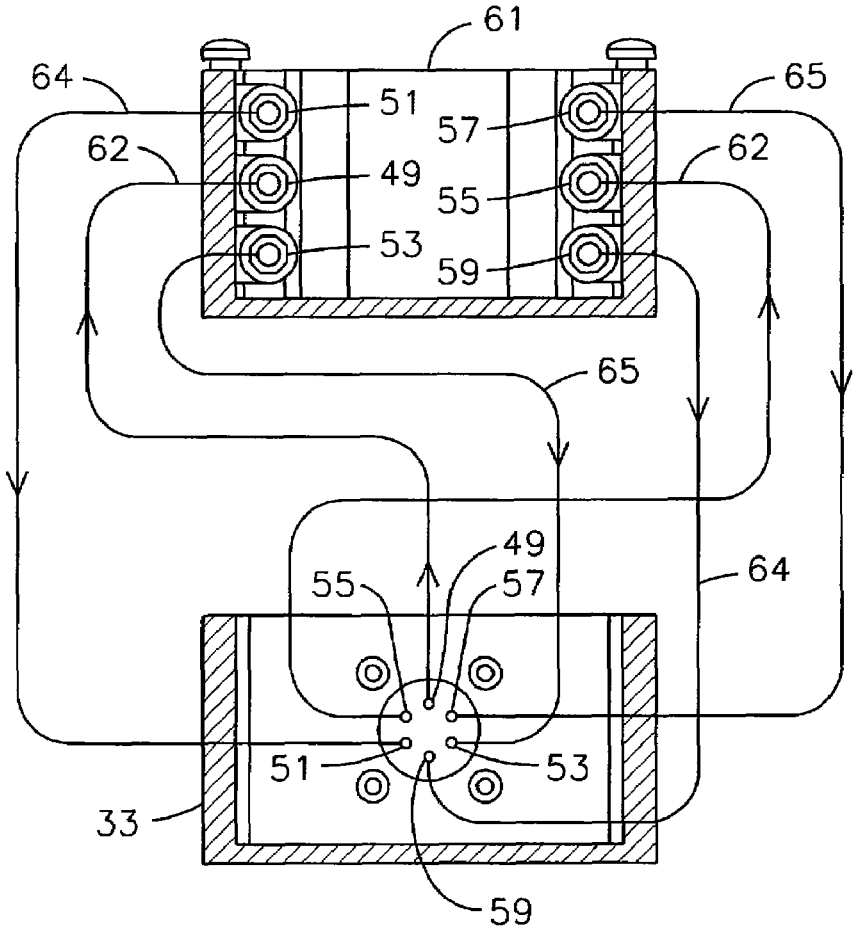
FIG. 5 is a top sectional view of one embodiment of a controller box in accordance with the present invention.

As illustrated in FIG. 5, the normal controller 33 is illustratively coupled to each outlet 49,51,53,55,57,59, and the normal controller outputs a high input signal 62 to respective outlets 49,55 corresponding to female contacts 54,71 aligned with the pair of middle contacts 40,41 of each side 36,38. The normal controller 33 is further responsive to a high output signal 64 from respective outlets 53,59 corresponding to female contacts 58,75 aligned with the pair of compressed contacts 46,47. The normal controller 33 is further responsive to a high output signal 65 from respective outlets 51,57 corresponding to female contacts 56,73 aligned with the pair of extended contacts 42,43.

As illustrated in FIG. 3, the normal controller box 13 further includes a spring 66 within the housing 28 to spring-load each block 30 within the housing. In addition, the controller box 13 includes a rod 68 to couple each block 30 to the normal and reverse switch point 16. The rod 68 is positioned to be more proximate to the pair of compressed contacts 40,46 than the pair of extended contacts 40,42. Although FIG. 3 illustrates one spring 66 and one rod 68 within the housing 28, more than one spring and rod may be utilized.

Each normal controller box 13 is selectively positioned adjacent to a normal and reverse stationary stock rail 20,22 such that each block 30 is in the compressed position 48 (FIG. 6) when either one of the normal and reverse switch point 16,18 is in the respective normal and reverse position (FIG. 1). Additionally, the normal controller box 13 is selectively positioned adjacent to the normal and reverse stationary stock rail 20,22 such that each block 30 is in the extended position 44 (FIG. 6) when either one of the normal and reverse switch point 16,18 is in the respective reverse and normal position (FIG. 2). The normal controller box 13' (in conjunction with software in the controller) may be used in railroad applications under power operation to detect if either the normal or reverse switch point 16,18 has been separated from the stock rail 20,22 after the normal controller box has moved and locked up. An example of such an instance of this is an improper "trailing" move by the oncoming train.

Figure 7:
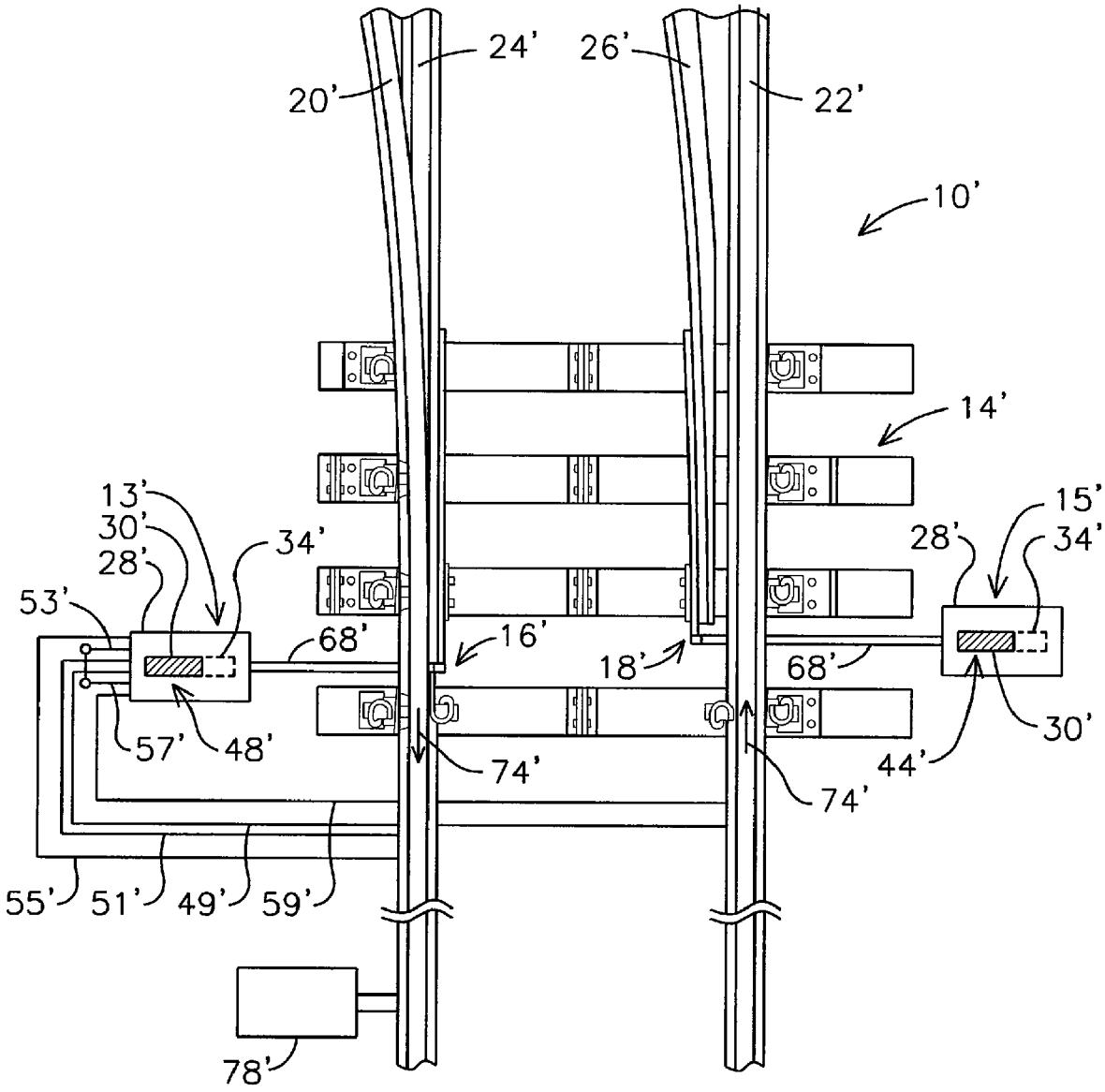
FIG. 7 is a top view of one embodiment of a system for providing temporary protection operation of a controller box for a railroad switch turnout in a normal position.
Figure 8:
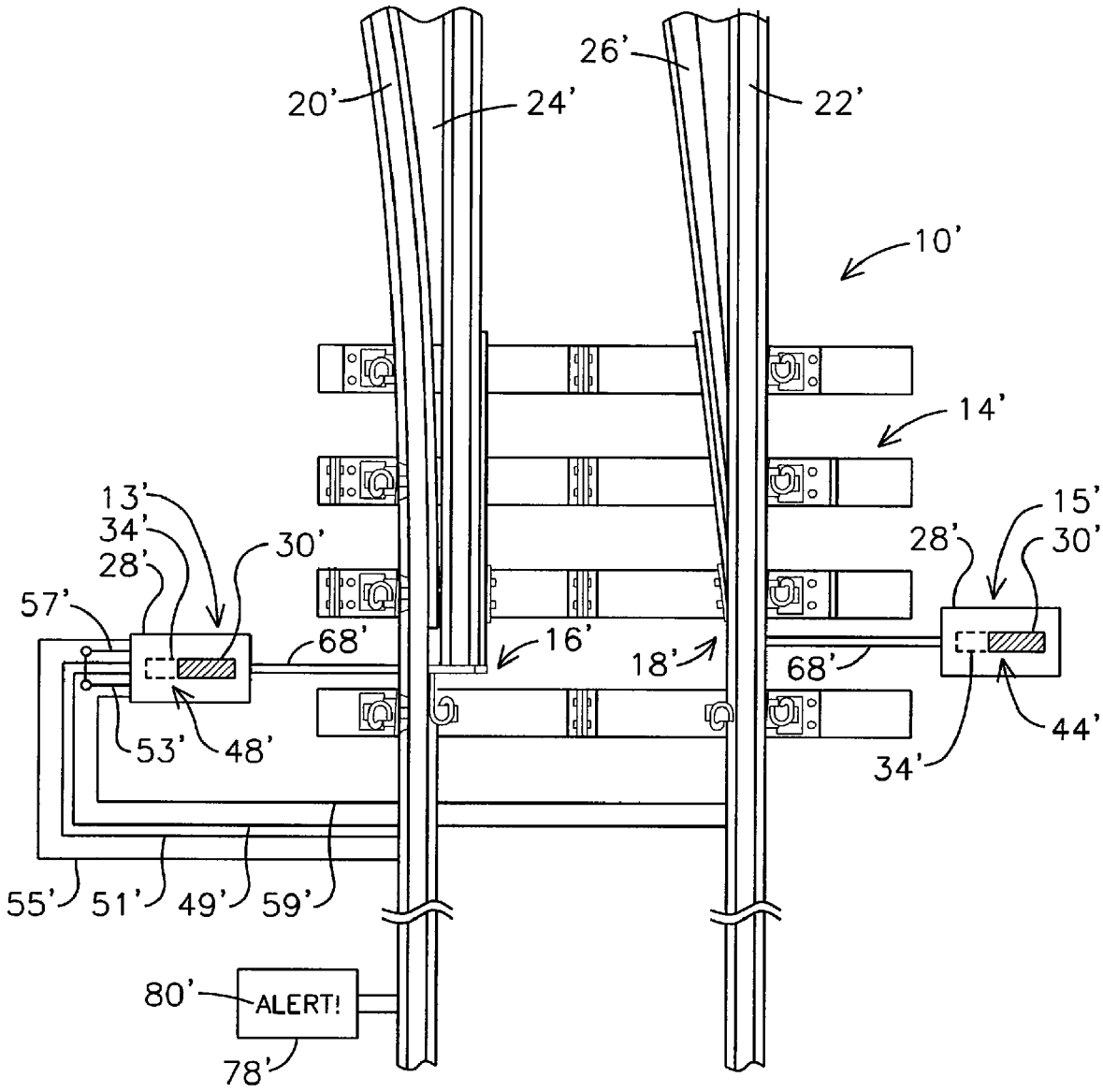
FIG. 8 is a top view of one embodiment of a system for providing temporary protection operation of a controller box for a railroad switch turnout in a reverse position.

FIGS. 7 and 8 illustrate an embodiment of system 10' for temporary protection operation of a normal controller box 13' and reverse controller box 15' for a railroad switch turnout 14' in a non-powered mode. The normal controller box 13' and reverse controller box 15' are structurally the same as the respective normal controller box 13 and reverse controller box 15 used in the powered mode, discussed above. Accordingly, each embodiment of the powered and non-powered mode provide the advantage of efficiency in terms of using the same controller box for each mode, the main difference being its wiring connections. However, the controller boxes of each of the powered and non-powered mode may not be identical.

Such a system 10' may be used in the railroad for new construction operation under temporary control guidelines, for example, and is referred to as "shunt and break" application, as appreciated by one of skill in the art. The railroad switch turnout 14' includes a normal and a reverse switch point 16',18' positioned between respective normal and reverse stationary stock rails 20',22', and a pair of movable switch rails 24',26' disposed between the stationary stock rails. The normal and reverse switch points 16',18' are movable between a normal position (FIG. 7) and a reverse position (FIG. 8). The system 10' for use in a non-powered mode may be used in the railroad in new construction operation under temporary control guidelines, and may be commonly referred to as "shunt and break" application, as appreciated by one of skill in the art.

The system includes a normal controller box 13' coupled to the normal switch point 16' to move the normal switch point between the normal position (FIG. 7) and the reverse position (FIG. 8). The normal controller box 13' illustratively includes a housing 28', a block 30' slidably received within the housing 28' based on moving the normal switch point 16' to establish one or more pair of electrical contacts within the housing. The pair of electrical contacts include a pair of compressed contacts 40',46' and 41',47' indicative of moving the normal switch point 16' into the normal position (FIG. 7) and a pair of extended contacts 40',42', and 41',43' indicative of moving the normal switch point 16' out of the normal position (FIG. 8).

Figure 9:
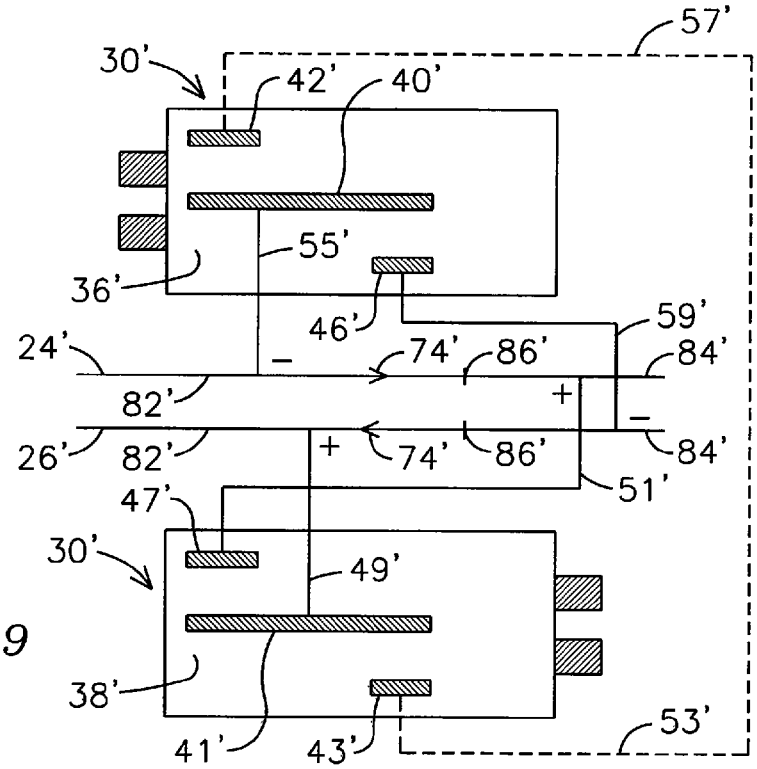
FIG. 9 is a partial sectional top view of the system for providing temporary protection illustrated in FIG. 7.

The normal controller box 13' further includes a pair of rail connections 49',51',53',55',57',59' to couple each pair of electrical contacts (40',46'), (41',47'), (40',42') and (41',43') to the respective normal and reverse stationary stock rails 20',22'. As illustrated in FIGS. 7 and 9, upon establishing each pair of compressed contacts (40',46') (41',47'), the pair of rail connections 55',59', and 49',51' and each pair of compressed contacts facilitate respective opposing current 74' along the normal and reverse stationary stock rails 20',22', indicative of a safe condition of the railroad switch turnout 14'. Upon establishing the pair of extended contacts (40',42') (41',43'), the pair of rail connections (55',57') and (49',53') and each pair of extended contacts facilitate shunting of the respective normal and reverse stationary stock rails 20',22' indicative of an unsafe condition of the railroad switch turnout 14'. Hence, when the block 30' is in the compressed position 48', the established compressed contacts (40',46') (41',47'), in addition to the respective rail connections (55',59') (49',51') facilitate passage of rail current 74' along each respective normal and reverse stationary stock rail 20',22'. However, when the block 30' moves into the extended position 44', the established extended contacts (40',42') (41',43') in addition to the respective rail connections (55',57') (49',53') facilitate shunting of the rail current 74' from the normal to the reverse stationary stock rail 20',22'. The rail connection 53',57' of the extended contacts 42',43' involve mutually coupling the extended contacts together, thereby shunting the rail current 74' from one stock rail between opposing sides 36',38' of the block 30' and to the opposing stock rail. This is commonly called the "break" part of a "shunt and break" application since the compressed contacts (40',46') (41',47') are normally in contact and passing track current along respective normal and reverse stationary stock rails 20',22'. Thus, breaking these contacts would shunt the tracks and thus alert the railroad control system of problem with the railroad switch turnout system. The block 30' of FIG. 9 is oriented opposite from the block 30 illustrated in FIG. 3, and would slide rightward into a housing, viewing FIG. 9, as oppose to slide leftward in FIG. 3.

Each block 30' includes a pair of electrical contacts on each of a respective side 36',38' of the block. As shown in FIG. 9, the pair of electrical contacts (40',42') (40',46') are on one side 36' of the block 30', while the pair of electrical contacts (41',43') (41',47') are on the opposing side 38' of the block 30'. The pair of electrical contacts on each respective side of the block are illustratively insulated from electrical contacts on opposing sides of the block. However, a block may be constructed within the scope of an embodiment of the present invention where the electrical contacts on opposing sides of the block are electrically connected.

Each pair of compressed contacts (40',46') (41',47') includes an electrical contact between a compressed contact 46',47' and a respective middle contact 40',41' on each respective side 36',38' of the block 30'. The pair of compressed contacts (40',46') (41',47') are established upon the block 30' being positioned in a compressed position 48' within the housing 28' and the normal switch point 16' being positioned in the normal position (FIG. 7). The pair of extended contacts (40',42') (41',43') includes an electrical contact between an extended contact 42',43' and a middle contact 40',41' on respective sides 36',38' of the block 30'. The pair of extended contacts (40',42') (41',43') are established upon the block 30' being positioned in an extended position 44' within the housing 28' and the normal switch point 16' being positioned outside the normal position (FIG. 8).

The pair of electrical contacts (40',42') (40',46') (41',43') (41',47') for each respective side 36',38' of the block 30' are attached to a respective normal and reverse stationary stock rail 20',22'. As illustrated in FIG. 9, each normal and reverse stationary stock rail 20',22', includes two adjacent insulated portions 82',84' separated by an insulated block 86'. Opposing current 74' is directed along each of the normal and reverse stationary stock rail 20',22' toward the insulated block 86' of each normal and reverse stationary stock rail 20',22'.

As illustrated in FIG. 9, the pair of compressed contacts (40',46') (41',47') includes an electrical contact between a compressed contact 46',47' and a middle contact 40',41' on each respective side 36',38' of the block 30'. Upon establishing the pair of compressed contacts (40',46') (41',47'), the opposing current 74' is directed through the pair of compressed contacts (40',46') (41',47') and between the adjacent insulated portions (82',84') of each of the normal and reverse stationary stock rails 20',22'.

As illustrated in FIG. 9, the pair of extended contacts (40',42') (41',43') includes an electrical contact between an extended contact 42',43' and a middle contact 40',41' on respective sides 36',38' of the block 30'. Upon establishing the pair of extended contacts (40',42') (41',43'), the opposing current 74' is directed through the pair of extended contacts and the pair of rail connections (55',57') (49',53') to shunt the normal and reverse stationary stock rails 20',22'.

Each pair of extended contacts (40',42') (41',43') are established by moving the normal switch point 16' greater than a predetermined distance from the normal position (FIG. 7), wherein the predetermined distance may be controlled by regulation or selectively varied, as appreciated by one of skill in the art.

As illustrated in FIGS. 7 and 8, the system 10' further includes an alert indicator 78' coupled to one of the normal and reverse stationary stock rails 20',22' to display an alert 80' responsive to shunting the stock rails.

Figure 10:
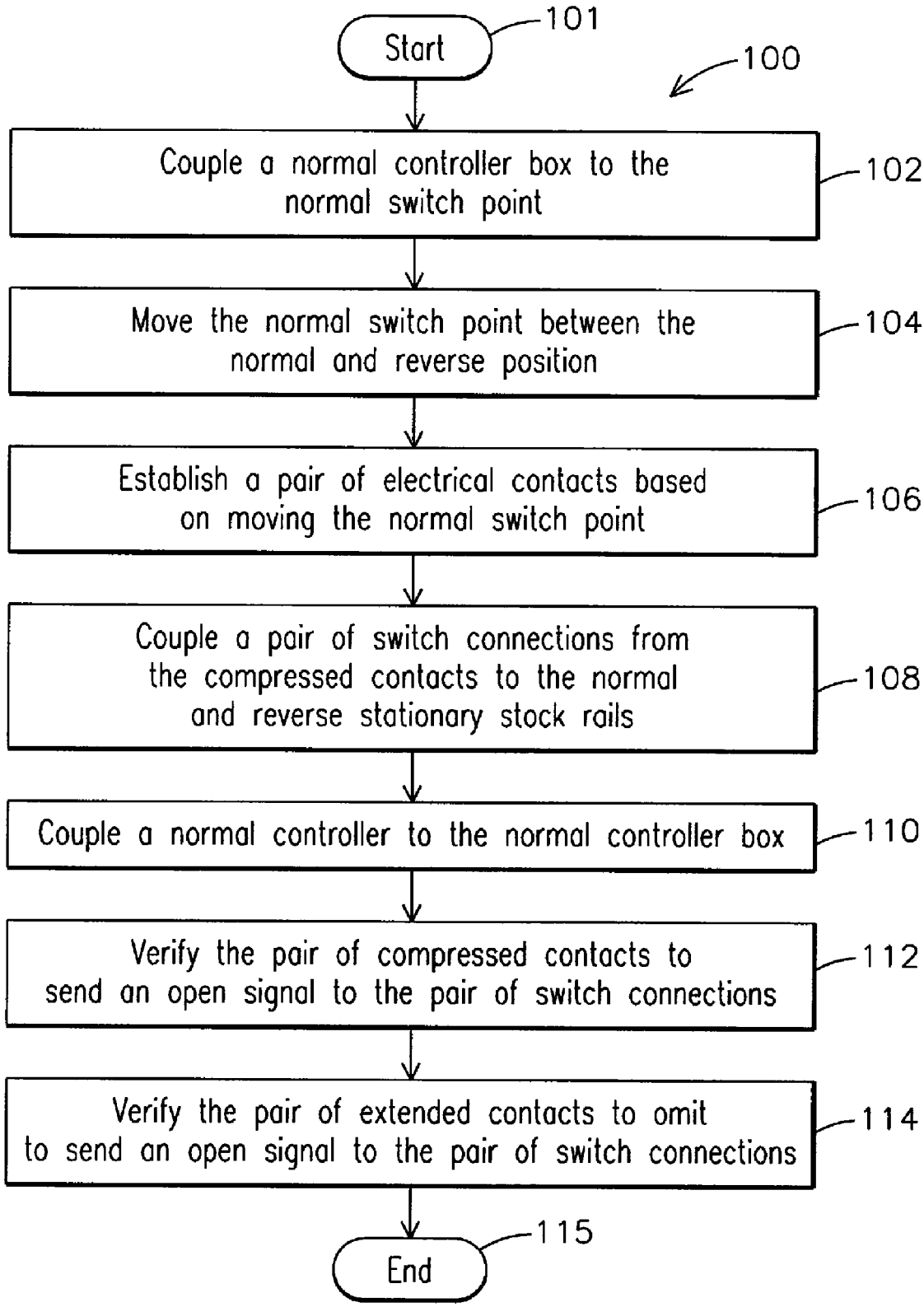
FIG. 10 is a flow chart illustrating an embodiment of a method for the system shown in FIG. 1

FIG. 10 illustrates an embodiment for a method 100 for temporary protection operation of a normal controller box 13 for a railroad switch turnout in a powered mode. The railroad switch turnout 14 includes a normal and a reverse switch point 16,18 positioned between respective normal and reverse stationary stock rails 20,22 and a pair of movable switch rails 24,26 disposed between the stationary stock rails. The normal and reverse switch points 16,18 are movable between a normal position and a reverse position. The method 100 begins (block 101) by coupling (block 102) a normal controller box 13 to the normal switch point 16. The method 100 further includes moving (block 104) the normal switch point 16 between the normal position (FIG. 1) and the reverse position (FIG. 2) including slidably receiving a block 30 of the normal controller box 13 within a housing 28 of the normal controller box 13.

The method further includes establishing (block 106) a pair of electrical contacts (40,42) (40,46) within the housing 28 based upon the moving the normal switch point 16 between the normal position (FIG. 1) and the reverse position (FIG. 2). The pair of electrical contacts (40,42) (40,46) include a pair of extended contacts (40,42) and a pair of compressed contacts (40,46). More particularly, the method includes coupling (block 108) a pair of switch connections 72 from the pair of compressed contacts (40,46) to the respective normal and reverse stationary stock rails 20,22 carrying respective rail current 74.

As further illustrated in FIG. 10, the method further includes coupling (block 110) a normal controller 33 to the normal controller box 13. Upon coupling the normal controller to the normal controller box, the method includes verifying (block 112) the pair of compressed contacts (40,42) to determine that the normal switch point 16 has moved to the normal position (FIG. 1) to cause the normal controller box 13 to send an open signal 76 to the pair of switch connections 72 to open the pair of switch connections. Additionally, the method includes verifying (block 114) the pair of extended contacts (40,46) to determine that the normal switch point 16 has failed to move to the normal position (FIG. 2) for omitting to cause the normal controller box 13 to send the open signal to the pair of switch connections 72 to maintain each respective switch connection for shunting the stationary stock rails 20,22.

Based on the foregoing specification, the embodiments of the invention may be implemented using computer programming or engineering techniques including computer software, firmware, hardware or any combination or subset thereof, wherein the technical effect is to provide temporary protection operation of a controller box for a railroad switch turnout in powered and non-powered modes. Any such resulting program, having computer-readable code means, may be embodied or provided within one or more computer-readable media, thereby making a computer program product, i.e., an article of manufacture, according to the embodiments of the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system embodying the method embodiment of the invention. An apparatus for making, using or selling the embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody embodiments of the invention.

This written description uses examples to disclose the embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for temporary protection operation of at least one controller box for a railroad switch turnout in a non-powered mode, the railroad switch turnout including a normal and a reverse switch point positioned between respective normal and reverse stationary stock rails and a pair of movable switch rails disposed between said stationary stock rails with said normal and reverse switch points being movable between a normal position and a reverse position, said system comprising:

at least one normal controller box coupled to said normal switch point for moving said normal switch point between said normal position and said reverse position, each controller box comprising:

a housing;

at least one block slidably received within the housing based upon moving said normal switch point for establishing at least one pair of electrical contacts within said housing, said at least one block configured to slidably translate within the housing between a compressed position and an extended position, said at least one pair of electrical contacts including at least one pair of compressed contacts being established based on said at least one block having slidably translated into said compressed position and moving said normal switch point into said normal position and at least one pair of extended contacts being established based on said at least one block having slidably translated into said extended position and moving said normal switch point out of said normal position, and at least one pair of rail connections coupling said at least one pair of electrical contacts to said respective normal and reverse stationary stock rails;

wherein upon establishing said at least one pair of compressed contacts, said at least one pair of rail connections and at least one pair of compressed contacts facilitate respective opposing current along said normal and reverse stationary stock rails indicative of a safe condition of said railroad switch turnout; and wherein upon establishing said at least one pair of extended contacts, said at least one pair of rail connections and at least one pair of extended contacts facilitate shunting of said respective normal and reverse stationary stock rails indicative of an unsafe condition of said railroad switch turnout.

2. The system for temporary protection operation of at least one controller box for a railroad switch turnout in a non-powered mode according to claim 1, wherein each of said at least one block includes said at least one pair of electrical contacts on each of a respective side of said at least one block.

3. The system for temporary protection operation of at least one controller box for a railroad switch turnout in a non-powered mode according to claim 2, wherein said at least one pair of compressed contacts comprises an electrical contact between a compressed contact and a middle contact on each respective side of said at least one block, thus passing track circuit through the controller box.

4. The system for temporary protection operation of at least one controller box for a railroad switch turnout in a non-powered mode according to claim 2, wherein said at least one pair of extended contacts comprises an electrical contact between an extended contact and a middle contact on respective side of said at least one block.

5. The system for temporary protection operation of at least one controller box for a railroad switch turnout in a non-powered mode according to claim 2, wherein said at least one pair of electrical contacts for each respective side of said at least one block are attached to a respective normal and reverse stationary stock rail.

6. The system for temporary protection operation of at least one controller box for a railroad switch turnout in a non-powered mode according to claim 5, wherein each of said normal and reverse stationary stock rail includes two adjacent insulated portions separated by an insulated block, and wherein opposing current is directed along each of said normal and reverse stationary stock rail toward said insulated block of each normal and reverse stationary stock rail.

7. The system for temporary protection operation of at least one controller box for a railroad switch turnout in a non-powered mode according to claim 6, wherein said at least one pair of compressed contacts comprises an electrical contact between a compressed contact and a middle contact on each respective side of said at least one block, and wherein upon establishing said at least one pair of compressed contacts, said opposing current is directed through said at least one pair of compressed contacts and between said adjacent insulated portions of each of said normal and reverse stationary stock rails.

8. The system for temporary protection operation of at least one controller box for a railroad switch turnout in a non-powered mode according to claim 6, wherein said at least one pair of extended contacts comprises an electrical contact between an extended contact and a middle contact on respective side of said at least one block, and wherein upon establishing said at least one pair of extended contacts, said opposing current is directed through said at least one pair of extended contacts and said at least one pair of rail connections to shunt the normal and reverse stationary stock rails.

9. The system for temporary protection operation of at least one controller box for a railroad switch turnout in a non-powered mode according to claim 6, wherein said at least one extended contact is established by moving said at least one normal switch point greater than a predetermined distance from said normal position.

10. The system for temporary protection operation of at least one controller box for a railroad switch turnout in a non-powered mode according to claim 8, further comprising an alert indicator coupled to one of said normal and reverse stationary stock rails for displaying an alert responsive to said shunting the stock rails.

* * * * *